United States Patent [19]

Kuhn

[11] 4,044,221

[45] Aug. 23, 1977

[54] FLEXIBLE HEATING ELEMENT FOR HEATING SEATS, IN PARTICULAR MOTOR VEHICLE SEATS, COUCHES, BERTHS OR THE LIKE

[75] Inventor: Gerald Kuhn, Evenhausen, Germany

[73] Assignee: Kommanditgesellschaft Warmetechnik B. Ruthenberg GmbH, Germany

[21] Appl. No.: 577,635

[22] Filed: May 15, 1975

[30] Foreign Application Priority Data

July 19, 1974 Germany ..... 7424704

[51] Int. Cl.[2] ..... H05B 1/00

[52] U.S. Cl. ..... 219/217; 219/528; 219/542; 219/549

[58] Field of Search ..... 219/217, 211, 213, 212, 219/345, 538, 542, 548, 527–529, 549; 128/376, 377; 338/208; 297/180

[56] References Cited

U.S. PATENT DOCUMENTS

| | | | |
|---|---|---|---|
| 2,708,234 | 5/1955 | Kerr | 219/529 X |
| 3,400,254 | 9/1968 | Takemori | 219/528 X |

FOREIGN PATENT DOCUMENTS

| | | | |
|---|---|---|---|
| 272,944 | 2/1966 | Australia | 219/217 |
| 1,077,798 | 8/1967 | United Kingdom | 219/217 |

*Primary Examiner*—C. L. Albritton

[57] ABSTRACT

A flexible electrical heating element includes a resistance heater which defines a seam, particularly a zigzag seam, supported on an air-permeable, flexible, flat plane-like carrier. The carrier, is fastened by means of closing-seams to a perforated plastic foam web. The heating element is suitable for use in heating seats or couches in motor vehicles and the like.

10 Claims, 2 Drawing Figures

FIG. 1
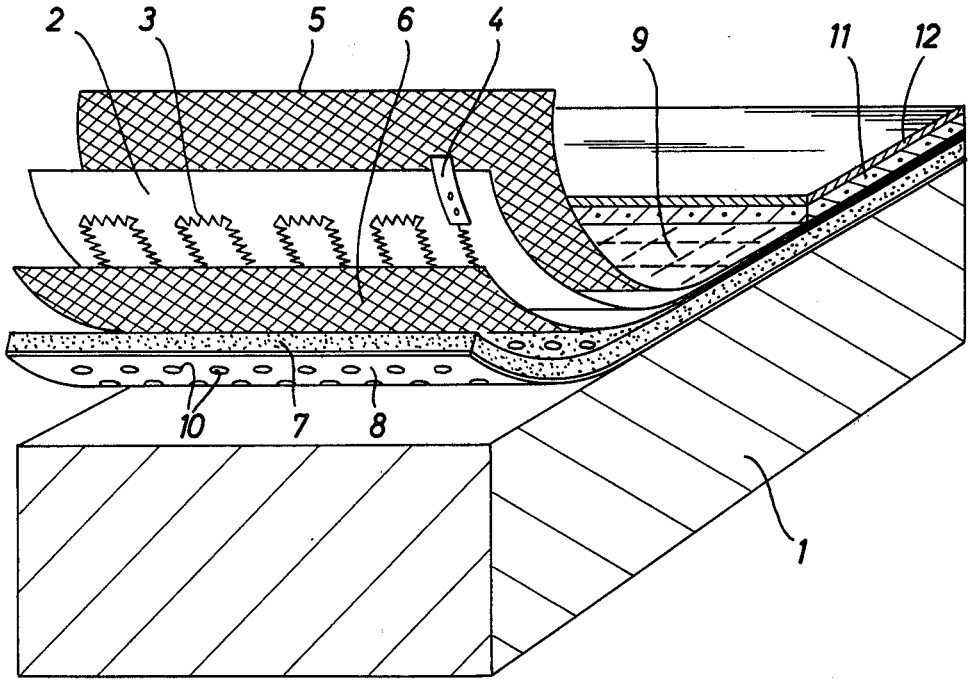
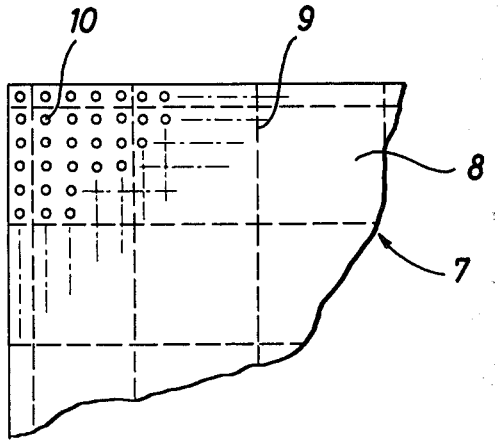
FIG. 2

FLEXIBLE HEATING ELEMENT FOR HEATING SEATS, IN PARTICULAR MOTOR VEHICLE SEATS, COUCHES, BERTHS OR THE LIKE

FIELD OF THE INVENTION

This invention relates to a flexible electrical heating element wherein a wire-shaped metallic conductor is secured to a flexible, flat planelike support or carrier.

DISCUSSION OF PRIOR ART

Known planar flexible heating elements have heating cables fixed on a supporting web; i.e., by stitching seams or by an adhesive; so that the heating element can, for example, be incorporated into a warming blanket or a heating pad.

However, if it is desired to include flexible electrical heating elements directly in a seat pad or couch in a manner such that the heating element is arranged near to the surface of the seat or couch, there arises the difficulty that the heating conductors of known flexible heating elements do not sufficiently uniformly heat the seat surface or couch surface. As an additional problem, the mechanical stresses during the use of the seat or couch can lead to breakage of the heating conductors of prior flexible electrical heating elements, and that the resiliency and breathing ability of the seat or couch upholstering pad are undesirably altered by the built-in electrical heating elements of known constructions.

SUMMARY OF THE INVENTION

Accordingly, a principal object of this invention is to provide a flexible electrical heating element which, in additional to having a high mechanical strength, does not disadvantageously change the properties of the surrounding seat cushion or couch cushion and which moreover can be manufactured in a relatively simple and inexpensive manner. In accordance with the present invention the above stated principal object is achieved through use of a heating conductor which is preferably formed as a seam, on an air-permeable flexible support or carrier; the air-permeable support being secured by closing seams to a plastic foam web provided with perforations.

The arrangement of the heating conductor as a seam permits a secure support of the heating conductor on an air-permeable supporting web without impairing the permeability of the latter by insulating material foils as has previously served to located and support the heating conductor. If the heating conductor is to be unilaterally or bilaterally kept separate from the respectively adjacent layers of a seat cushion or couch cushion, according to an advantageous embodiment of the invention, air permeable woven fabric webs are provided which are laminated to both sides of said support and the heating conductor seams arranged thereon. Such woven fabric webs, because of a special preparation, can be joined to said support by a technique such as ironing.

The closing-seams which interconnect the heating conductor and its carrier supports and optionally also the woven fabric webs laminated thereto, to the plastic foam web, enhance the flexibility of the entire assembly because they form an indentation in the plastic foam web, whereby a good flexibility of the heating element is achieved.

The perforations in the plastic foam web cause a further increase of the flexibility and, in conjunction with the air-permeability of the support or carrier, they ensure the breathing ability of the heating element.

In spite of the high flexibility of the heating element, the heating conductors — thanks to their construction as heating conductor seams — can resist the occurring mechanical stresses during a long service life.

BRIEF DESCRIPTION OF THE DRAWING

A preferred embodiment of the invention is elucidated in greater detail hereinafter with reference to the enclosed drawing in which FIG. 1 shows a schematical perspective view of a flexible electrical heating element in conjunction with a seat cushion, and FIG. 2 shows a bottom plan view of the heating element according to FIG. 1.

DETAILED DESCRIPTION OF THE PREFERRED EMBODIMENT

A flexible electrical heating element comprising a heating conductor or carrier support 2 in the form of a thin heat proof woven web is shown associated with a seat cushion core 1. Over the heating conductor support or carrier 2 there extend meanderlike heating conductor zig-zag seams 3. Seams 3 are formed of a thin resistance heater wire and are connected to terminal tabs 4. Woven fabric webs 5 and 6 are laminated to both sides of carrier 2; webs 5 and 6 like the heating conductor support or carrier 2, being air-permeable and impart an additional mechanical support to the structural member formed of the heating conductor carrier 2 and the heating conductor zig-zag seams 3.

A plastic foam web 7, the underside of which is provided with a plastic foil layer 8 is positioned beneath a woven fabric web 5. The plastic foam web 7 is connected to the laminate formed of the woven fabric webs 5 and 6 and of the heating conductor support or carrier 2 by closing-seams 9 which are laid so that they extend in a direction substantially parallel to the zig-zag seams 3. Along the closing-seams 9, the plastic foam of the plastic foam web 7 is compressed between the plastic foil 8 and the woven fabric webs 2, 5 and 6 so that the closing seams define indentations by which the flexibility of the laminate is enhanced.

From the drawing it is apparent that the plastic foam web 7 and also the plastic foil 8 are provided with a dense pattern of perforations 10 permitting air exchange between the seat cushion core 1 and the surrounding air through the air-permeable woven fabric members 2, 5 and 6.

In the embodiment according to FIG. 1 there is also provided a thin cushion layer 11 above the heating element. Cushion layer 11, which can include a shield grid, forms a support on which the cushion-case 12 rests.

In distinction from the embodiment shown in FIG. 1 the heating wire seams arranged on the heating conductor support or carrier 2 may be also made rectilinear; but the zig-zag seam is preferred because of the extensibility in longitudinal direction of the seam. By a more or less close juxtaposition of the seams, the construction of the heating conductors in the form of a heating wire seam permits the desired control of the heat emission per surface area unit over the surface of the heating element and thus over the seat surface or couch surface, respectively.

What is claimed is:

1. A flexible electrical heating element comprising:

a planar carrier sheet, said carrier sheet being formed of an air permeable material;

an electrical heater, said heater being in the form of a conductive wire which defines a seam on said carrier sheet;

a perforated foam member, said foam member having a first side facing a first side of said carrier sheet; and means mechanically interconnecting said carrier sheet and foam member, said interconnecting means including closing seams.

2. The heating element of claim 1 wherein said heater conductive wire defines a zig-zag seam.

3. The heating element of claim 2 further comprising:

a first air permeable woven fabric web, said first fabric web being laminated with said carrier sheet and being disposed between said carrier sheet and said perforated foam member.

4. The heating element of claim 3 further comprising:

a second air permeable woven fabric web, said second fabric web being laminated with said carrier sheet and being disposed on the opposite side of said carrier sheet from said first fabric web.

5. The heating element of claim 4 further comprising:

a perforated plastic foil layer, said plastic foil layer being in contact with the second side of said perforated foam member.

6. The heating element of claim 5 wherein said foam member is compressed in the vicinity of said interconnecting means closing seams whereby said closing seams define indentations in said heating element.

7. The heating element of claim 1 wherein said interconnecting means closing seams extend substantially between said conductive wire defined seams.

8. The heating element of claim 1 wherein said planar carrier sheet is comprised of a woven fabric web.

9. The heating element of claim 1 further comprising:

a perforated plastic foil layer, said plastic foil layer being in contact with the second side of said perforated foam member.

10. The heating element of claim 3 further comprising:

a perforated plastic foil layer, said plastic foil layer being in contact with the second side of said perforated foam member.

* * * * *